United States Patent [19]

Hudson

[11] Patent Number: 4,799,330

[45] Date of Patent: Jan. 24, 1989

[54] SASH LOCKING AND SEALING ASSEMBLY

[75] Inventor: Timothy R. Hudson, Cassville, Mo.

[73] Assignee: Efco Corporation, Monett, Mo.

[21] Appl. No.: 59,042

[22] Filed: Jun. 8, 1987

[51] Int. Cl.[4] ..... E05C 7/02

[52] U.S. Cl. ..... 49/62; 49/67; 49/163; 292/217; 292/218

[58] Field of Search ..... 49/62, 67, 163, 168; 292/217, 218

[56] References Cited

U.S. PATENT DOCUMENTS

| | | | |
|---|---|---|---|
| 2,142,907 | 1/1939 | Mains | 292/218 |
| 3,427,747 | 2/1969 | Ober, Sr. | 49/62 X |
| 3,947,997 | 4/1976 | Mursula | 49/62 |
| 4,302,907 | 12/1981 | Canals et al. | 49/67 X |
| 4,389,817 | 6/1983 | Olberding | 49/62 X |

*Primary Examiner*—Philip C. Kannan

*Attorney, Agent, or Firm*—Rogers, Howell, Moore & Haferkamp

[57] ABSTRACT

A locking and sealing assembly locks two window sashes to each other so that they can pivotally move together relative to a casing. The assembly locks the interior sash to the casing while disengaging the lock between the two sashes, so that the interior sash urges sealing material on it to press sealing material on the exterior sash against the casing to provide a weather seal. In a preferred embodiment, the assembly has a lock shaft with a pair of radial lugs. Catches each having a curved surface flange are mounted to the exterior sash and to the casing, and have lengths at least thrice the lug width. The shaft can be moved so that a shaft lug engages the exterior sash to hold the two sashes together. When the two sashes are moved to within the casing, the lock is moved to disengage the lug while simultaneously moving another lug to lock the interior sash to the casing.

29 Claims, 3 Drawing Sheets

SASH LOCKING AND SEALING ASSEMBLY

FIELD OF THE INVENTION

This invention relates to locking mechanisms for securing window sashes to one another and to a window casing, and to providing weather seals about the casing and sashes. In the prior art, windows have had two separate sashes, each of which can pivot independently of one another relative to the casing to which they are mounted by hinges. Heretofore, two separate locking mechanisms have been used to secure the exterior sash to the interior sash, and to secure the interior sash to the casing.

It is advantageous to pivot the sashes inwardly for ventilation. When this is done, it is preferable to have the sashes fastened to each other. Such fastening keeps the sashes, especially the exterior sash, from being fanned by the wind or pressure differences to swing back and forth within the interior of the office or room. This swinging is distracting, and in some cases, the exterior sash could be moved all the way back toward a near closing position with the casing. Such swinging is also undesirable for safety reasons because of possible striking of a person or other object and inflicting damage or injury.

It is furthermore desirable to have the sashes fastened to each other when the window is open in order to prevent dust, debris and the like from entering between the two sashes to tarnish or dirty the surfaces of the window panes and sash structures.

In addition to ventilation, it is also beneficial to pivot the sashes inwardly so that the exterior pane surface for the exterior pane sash can be cleaned from the inside the room. This obviates the need for having window cleaners suspended on platforms to travel dangerously up and down the sides of buildings.

The lock used to secure the exterior and interior sashes to each other has in one example comprised a keeper mounted to the side of one sash. A pivotal latch plate was mounted to a side of the other sash. The latch had a hook at its end. The latch pivoted over the keeper so the hook engaged a notch in the keeper. The latch was then pressed flat against the keeper to lock the two sashes together. In some cases two of such locks would be used for a pair of large sashes. Other similar types of locks have been used to secure the first sash to the second sash.

In the prior art, the interior sash has been held to the casing by a rotatable latch mounted to the interior sash and a catch plate mounted to the casing wall. The latch had a short rod with a single radial lug. The catch had a curved projecting flange. The rod could be rotated to engage the lug in the center of the catch to lock the interior sash to the casing.

Difficulties have been encountered with the prior art latching systems. When the prior art latch system has been operated to lock the interior sash to the casing, the latch holding the two sashes has inadvertently popped open. This meant that when the interior sash was unlocked from the casing and pivoted inwardly, the exterior sash would not move with it, and thus the above-discussed problems of having two unfastened sashes were encountered.

Another difficulty with the prior art was that when the two sashes were pivoted inwardly, the sash hinges would be supporting substantial weight. This weight in some cases caused one sash to sag more than the other.

This disproportionate sagging has caused the latch for the sashes to disengage to present the above-discussed problems for unfastened sashes. In some instances, the disproportionate sagging would destroy the prior art latch to render it useless for future latching.

The prior art latch between the sashes also could be difficult to unlock because a good deal of hand pressure was applied to press the latch down about the keeper. As a result, a lot of hand pressure was needed to disengage the latch.

The problem of solving the above difficulties has been increased because of the fact that the space between the casing and the exterior sash is small and hence there is not room for large locking mechanisms.

The prior art exterior sash had weather stripping mounted to its exterior for pressing against the casing to provide a weather seal therebetween. The prior art interior sash had an exterior wall with a flexible rubber-like gasket, such as of neoprene, mounted within a slot. When the interior sash was locked to the exterior sash by the prior art lock, the gasket would engage against the frame of the exterior sash. However, because the lock held the sashes in fixed position relative to each other, the locking of the interior sash to the casing did not take advantage of the contact between the interior sash gasket with the exterior sash. As a result, in cases when the tolerances were such that the exterior sash weather stripping did not properly engage the casing when the two sashes were locked together, there would be ineffective sealing between the exterior sash and the casing. This lack of sealing permitted moisture, cold air, ice and snow to penetrate past the exterior sash.

SUMMARY OF THE INVENTION

The present invention provides advantages over the prior art. The invention comprises a locking and sealing assembly which can lock the exterior and interior sashes together so that they can move jointly to and from the casing, and remain latched together when the window is opened for ventilation and cleaning. When the exterior and interior sashes are moved together to be in alignment with the casing, the locking assembly can disengage the two sashes from each other while simultaneously locking the interior sash to the casing. When this happens, the locking assembly urges the interior sash in an exterior direction. This causes a sealing device, such as a gasket on the interior sash, to press against the exterior sash to thereby press weather stripping on the exterior sash against the casing panels to effect a snug seal thereagainst.

The invention can utilize a single locking member to lock the two sashes to one another, and to lock the interior sash to the casing. The use of a single locking member to carry out the locking operations saves manufacturing steps, time, materials and cost. It also provides advantageous ease and convenience in the actual operation of opening and closing the window and in locking the sashes into position.

The invention can comprise a lock handle with a shaft. The shaft can have a pair of lugs extending therefrom. When the two sashes are moved together, the lock handle rotates the shaft to move one lug to engage a catch on the exterior sash to hold the two sashes together. The handle can move the sashes toward the casing. When the sashes are aligned with the casing, the lock handle is easily and conveniently moved to disengage the lug that holds the two sashes together, while simultaneously another lug moves to contact a catch on the casing for locking the interior sash thereto.

Both the casing and exterior sash can have lock catches with projecting flanges having a curved ramp surface. As one lug moves down its sloping ramp surface, the other lug moves up its catch ramp surface. As one lug moves into its ultimate locking position against its catch flange, the other lug is disengaged from its catch. The shaft rotation can be limited to about ninety degrees, and the lugs mounted radially at about ninety degrees.

With the present assembly, the prior problem of the lock for the two sashes popping loose when the interior sash is secured to the casing is solved. Since the new assembly disengages the latching of the two sashes simultaneously with the latching of the interior sash to the casing, such problem is eliminated. Yet the new assembly is easily operated to reengage the two sashes to each other while disengaging the interior sash from the casing. Thus with easy hand operation both sashes can be moved together away from the casing to open the window for ventilation or cleaning.

The present invention overcomes the problem of sash sagging causing stress upon the lock to disengage the sashes from each other. With the present invention, the interaction of the locking mechanism is such that even with such sagging of one sash to another, the locking of the two sashes together is maintained. One embodiment provides for the length of the relevant catch part on the exterior sash to be at least thrice the width of the lug. The lug is preferably positioned approximately centrally to the catch part to maintain the sash locking despite a play in the sash positions.

The invention solves the prior art problem without causing an increase in the space between the casing and the sashes to accommodate the new assembly.

It is therefore an object of the invention to effectively lock the sashes within the casing while providing a good seal between the exterior sash and the casing and between the two sashes.

It is further an object of the invention to hold the two sashes together in locked position when they are pivoted to the interior for purposes of ventilation or cleaning.

Another object of the invention is to maintain the sashes locked to each other when the sashes are pivoted to the interior and one sash sags relative to the other sash.

It is moreover an object to provide an assembly that permits the two sashes to be locked and unlocked together with ease and in a short time. It is likewise an object to allow the interior sash to easily and quickly be locked and unlocked to the casing.

It is an object of the invention to provide an assembly that can, through operation of a single member, lock the interior sash to the casing and effect a seal of the exterior sash to the casing, as well as lock the two sashes to each other so that the sashes are held together when the sashes are pivoted toward the interior of the window.

It is an object of the invention to provide a locking and sealing assembly that provides ease and economy in assembly and manufacture.

Other advantages and objects will become apparent in the further description that follows.

DESCRIPTION OF PREFERRED EMBODIMENT

Figures 1, 2, 3:
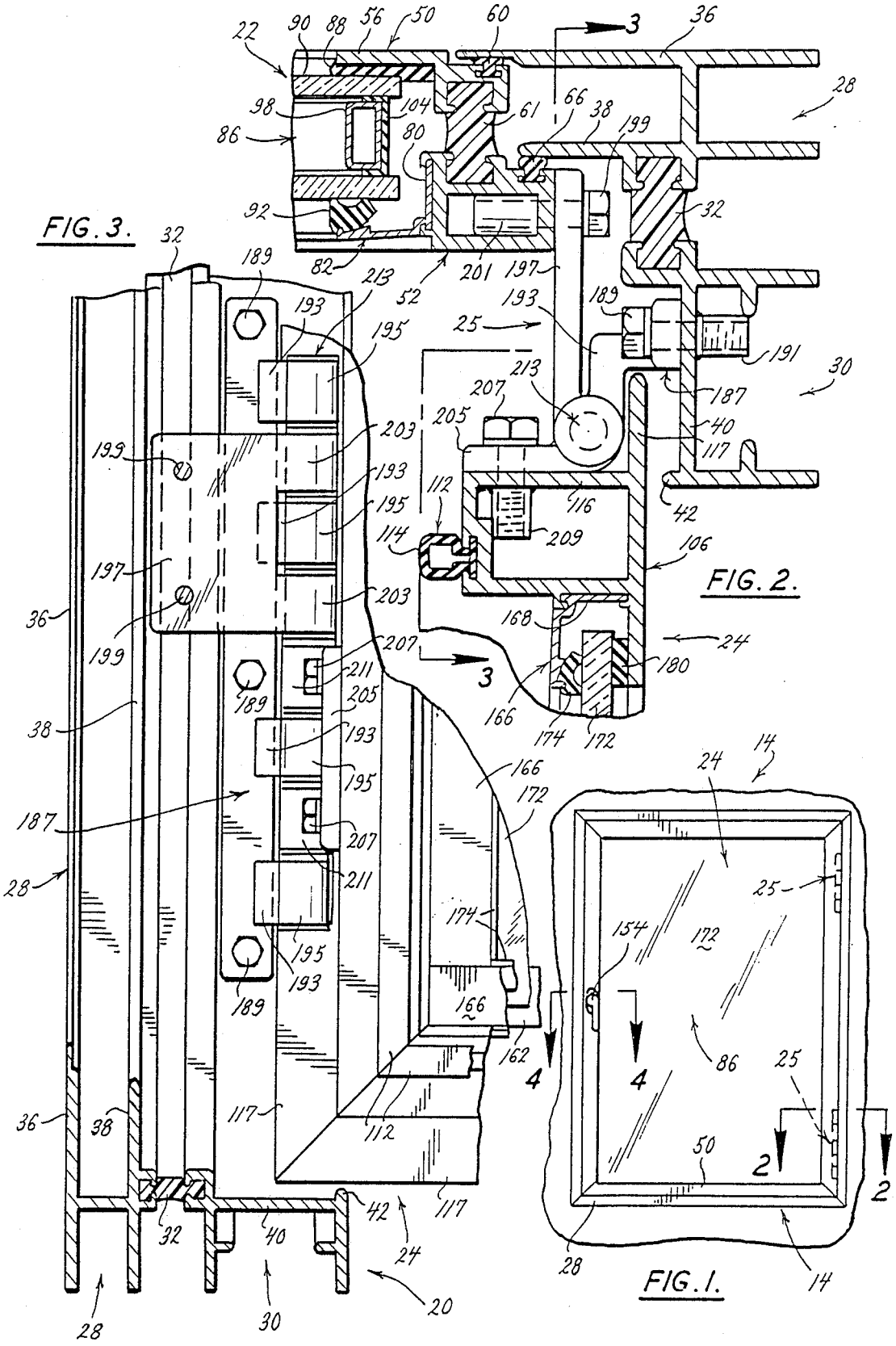
FIG. 1 is a front elevation view of a window utilizing the locking and sealing assembly.
FIG. 2 is a section taken on the line 2—2 of FIG. 1.
FIG. 3 is a section taken on the line 3—3 of FIG. 2.

The drawings show generally a window 14 having an exterior side 16 and interior side 18. Later members described will have corresponding exterior and interior sides. Window 14 has a stationary casing 20. An exterior sash 22 and an interior sash 24 are pivotally mounted to casing 20 by a pair of hinge assemblies 25. A locking and sealing assembly 26 can secure the two sashes 22 and 24 together, as well as secure sashes 22 and 24 to casing 20 to effect a tight seal between the exterior sash 22 and casing 20, and between sashes 22 and 24. Locking assembly 26 permits both sashes 22 and 24 to pivot outwardly from casing 20 to open window 18.

More specifically, the casing 20 comprises an exterior casing 28 and an interior casing 30, both of which extend the length of casing 20. Interior and exterior casings 30 and 28 are rigidly connected and spaced from one another by a conventional structural thermal barrier 32, such as that disclosed in Nilsen, U.S. Pat. No. 3,204,324. Barrier 32 comprises a synthetic resin or other suitable material having a substantially lower heat conductivity than the exterior and interior casings 28 and 30.

Exterior casing 28 has exterior and interior inwardly extending panels 36 and 38, respectively, for engaging weather stripping to be described.

Interior casing 30 has a wall 40 whose interior end has a rib 42 extending inwardly therefrom. A catch 44 having an inwardly projecting flange 46 is mounted by screws 47 to wall 40. The flange 46 is ramped shaped as will be shown more fully for a catch to be described.

The exterior sash 22 has an exterior frame 50 and an interior box shaped frame 52. Exterior frame 50 has an outer flange 54 which jogs inwardly into an integral inner leg 56. The exterior side of flange 54 has a recess which receives the interior end of weather stripping 60, as known in the art. Stripping 60 is of deformable insulating material of reduced heat conductivity, such as neoprene.

A thermal barrier 61, like that of barrier 32, connects exterior frame 50 and interior frame 52. Interior box frame 52 has a front wall 64 having a recess that receives weather stripping 66 which is like stripping 60. Both stripping 60 and 66 extend the length of sash 22.

Figure 4:
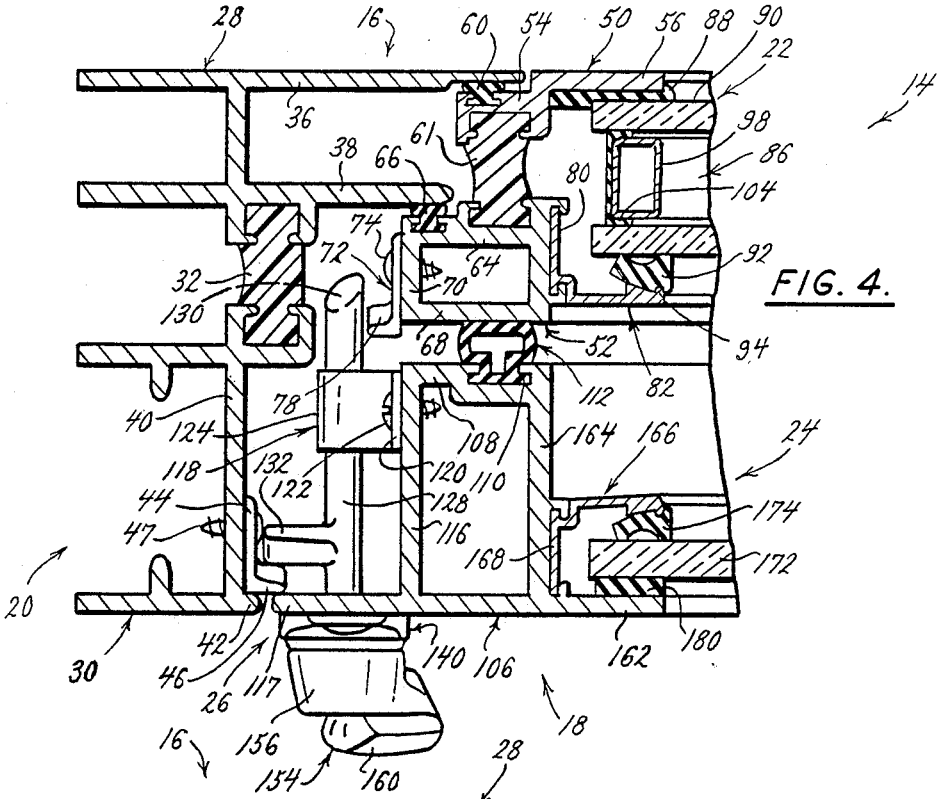
FIG. 4 is a section taken on the line 4—4 of FIG. 1.

As seen in FIGS. 2 and 4, when the exterior sash 22 is locked in the inventive way, the exterior surfaces of the strippings 60 and 66 are pressed firmly against the interior sides of casing panels 36 and 38, respectively. This deforms strippings 60 and 66 so as to effect a tight seal between panels 36 and 38 and sash frames 50 and 52.

The interior surface 68 of box frame 52 sealingly engages a gasket to be described.

Figure 6:
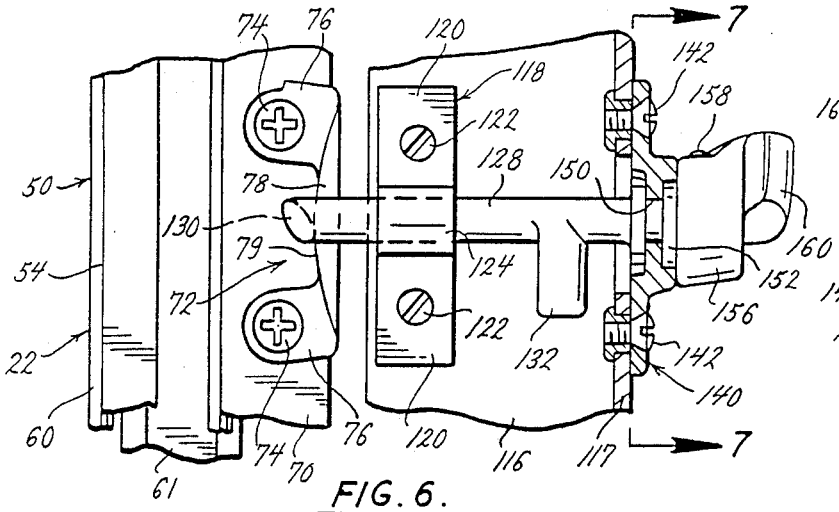
FIG. 6 is a section taken on the line 6—6 of FIG. 5.

The outer wall 70 of box frame 52 has a catch 72 secured thereto by a pair of screws 74 passing through catch legs 76 (FIGS. 6 and 4). Catch 72 is shaped identical to catch 44. Catch 72 has a flange 78 extending outwardly. Flange 78 has its exterior surface 79 bowing into an arcuate ramp shape. The ramp shapes of the catch flanges 46 and 78 provide smooth latching surfaces for latch lugs to be described.

The box frame 52 has a pair of recesses that receive the ends of a wall 80 of a metal clip 82 to hold the clip 82 thereto. A window lite 86 is held between the sash frames 50 and 52. A layer 88 is a glazing tape and structural silicone cap bead which bonds the outer surface 90 of lite 86 to the inside of frame leg 56. On the opposite side of lite 86, a gasket 92 of deformable material such as dense neoprene has an interior recess that receives a finger 94 at the inside end of clip 82 to be held thereto. The exterior two-pronged surfaces of gasket 92 are thus firmly pressed against the interior surface of lite 86 to firmly hold lite 86 within sash frames 50 and 52. The lite 86 has the usual intermediate spacer 98 with a bonding agent 104, such as silicone rubber, holding the spacer 98 to lite 86.

Figure 5:
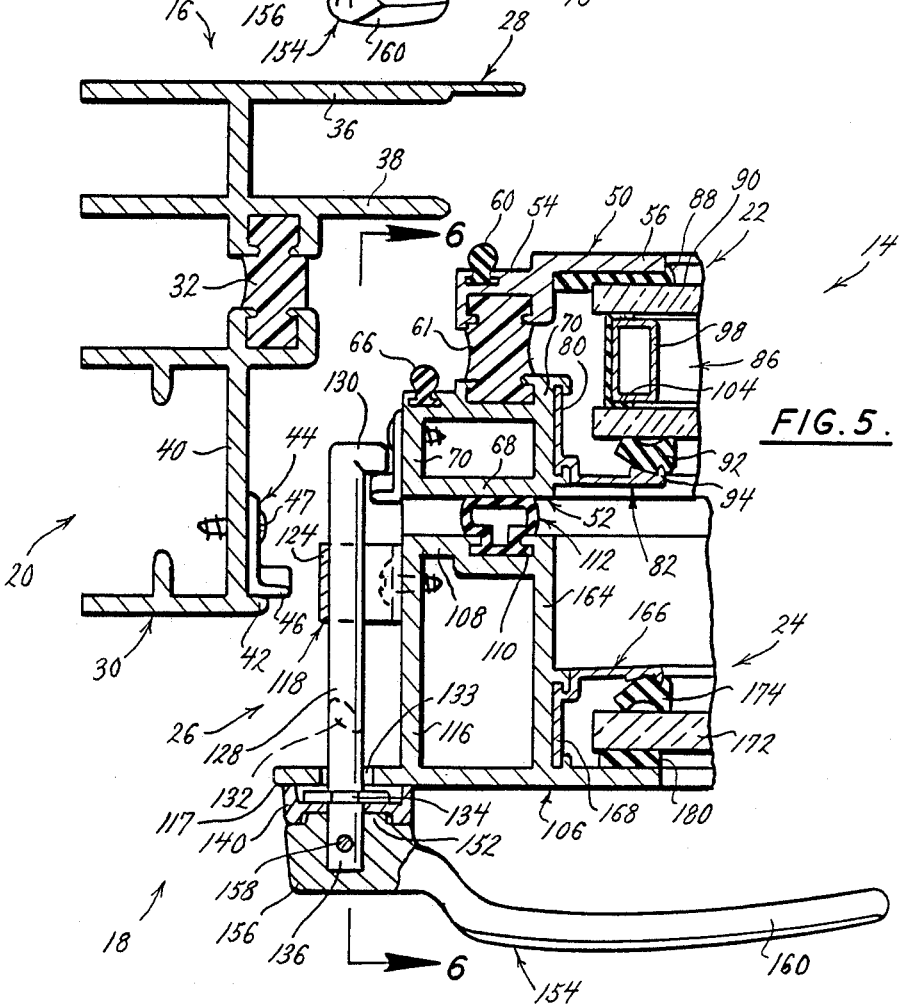
FIG. 5 is a section similar to the FIG. 4 section except that the locking assembly has disengaged the interior sash from the casing and has engaged the interior and exterior sashes to one another, and the two sashes have been pivoted away from the casing, with the casing catch not shown.

Turning now to the interior sash 24, it has a main frame 106 with an exterior wall 108. Wall 108 has a "T" groove that receives a T-shaped rib 110 of a gasket 112. Gasket 112 is of a deformable material of reduced heat conductivity such as closed cell neoprene. The exterior gasket surface 114 (FIG. 2) presses against the interior surface 68 of outer sash frame 52 when the inner sash 24 is locked to outer sash 22, as shown in FIG. 5, and also when the inner sash 24 is locked to casing 20 as shown in FIG. 4.

Main frame 106 has an outer wall 116 and an outwardly extending flange 117. A "U" shaped bracket 118, which comprises part of the locking assembly 26, has a pair of flat feet 120 secured by screws 122 to wall 116. Bracket 118 has a "U" bend 124 so that a pathway between bend 124 and wall 116 is defined to receive a latch shaft 128.

The locking assembly also comprises latch shaft 128, which has a lug 130 at its exterior end that acts to engage catch 72 to hold sashes 22 and 24 together. Latch shaft 128 has an interior lug 132 which serves to engage catch 44 to hold the interior sash 24 to casing 20. Lugs 130 and 132 project radially from shaft 128 with the angle formed between lugs 130 and 132 in the radial direction being approximately ninety degrees.

Figure 7:
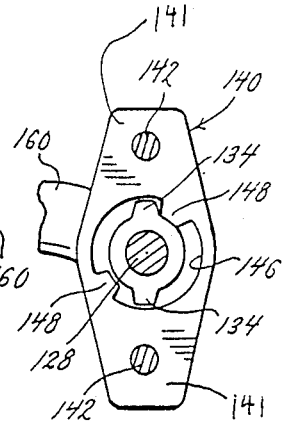
FIG. 7 is a section taken on the line 7—7 of FIG. 6.

The shaft 128 thence extends to the interior through an opening 133 in main frame flange 117. On the interior side of flange 117, shaft 128 has a pair of projections 134 (FIG. 7). From projections 134, shaft 128 extends into an inner end section 136.

A latch mount bracket 140 has a pair of flat feet 141 secured by screws 142 to sash flange 117. Bracket 140, as seen clearly in FIG. 7, has a circular cavity 146 with a pair of tabs 148 projecting radially inward. Bracket 140 has a cylindrical bearing bore 150 located centrally of cavity 146 through which shaft end 136 passes. Bracket 140 has an interior recess which receives the exterior hub 152 of a latch handle 154.

The hub 152 extends into an enlarged handle base 156. A cylindrical bore extends through hub 152 and base 156, and telescopically receives the shaft end 136. A set pin 158 passes through a bore in base 156 and thence through a bore in shaft end 136 so that rotation of base 156 rotates shaft 128. A grip extension 160 projects from base 156.

Inner sash frame 106 has an inwardly extending flange 162, and an inner wall 164. A metal clip 166 has an outer leg 168 held by its ends to frame walls 162 and 164 by a pair of nibs projecting from those walls.

A glass pane 172 is mounted in interior sash 24. A gasket 174 is like gasket 92, and likewise has a recess which receives a finger on the end of clip 166. Clip 166 holds the interior two-pronged surfaces of gasket 174 against pane 172. The sash frame flange 162 has a layer of bonding material 180, like material 88, to bond it to pane 172 to mount pane 172 securely in sash 24.

The exterior sash 22 and interior sash 24 are mounted by hinge assemblies 25 so that each sash can independently pivot relative to casing 20. Referring now to FIGS. 1, 2 and 3, one of the two pairs of identical assemblies 25 is shown in FIGS. 2 and 3. FIGS. 2 and 3 show inner sash 24 pivoted completely to the interior window side 18, with exterior sash 22 in the closed position. Each assembly 25 has a main bracket 187 secured by bolts 189 passing therethrough and through wall 40 of inner casing 30, and nuts 191. Bracket 187 has four "L" shaped legs 193 with cylindrical end tubes 195.

A flat pivot brace 197 is secured by bolts 199 and nuts 201 to frame 52 of exterior sash 24. Brace 197 extends into two mount tubes 203. The inner sash 24 has a flat pivot brace 205 secured by bolts 207 and nuts 209 to outer wall 116 of main sash frame 106. Brace 205 has two end tubes 211 axially aligned with tubes 203 and 195. Tubes 211, 203 and 195 are pivotally held together by a pin and cap assembly 213 as known in the art.

Figure 8:
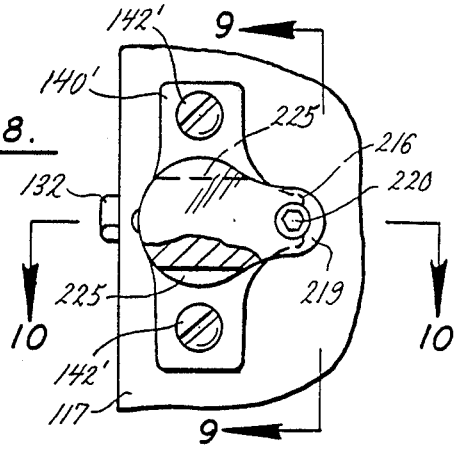
FIG. 8 is a front plan view, with some parts being broken, of a modified latch with removable handle.
Figure 9:
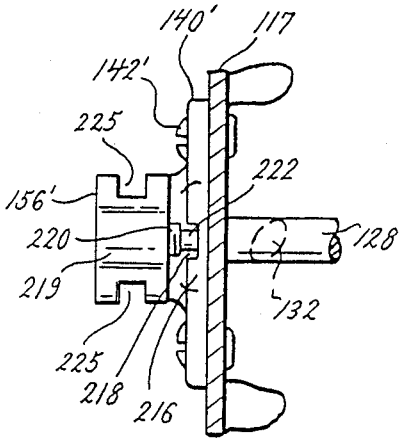
FIG. 9 is a section taken on the line 9—9 of FIG. 8.
Figure 10:
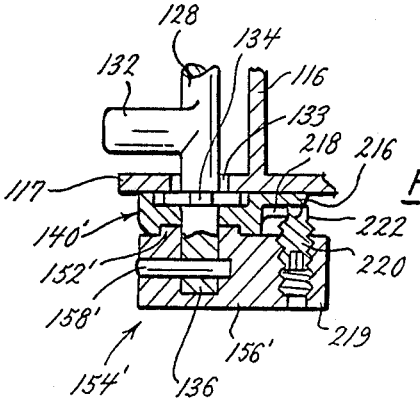
FIG. 10 is a section taken on the line 10—10 of FIG. 8.

FIGS. 8, 9 and 10 show a different latch handle. Handle 154' is designed so that maintenance personnel having special equipment, i.e., a removable handle, can turn it, but normal occupants of the building cannot. Accordingly, the latch handle 154' has no grip extension 160. The base 156' receives the shaft end 136 with pin 158' holding shaft end 136. Bracket 140' differs from bracket 140 in that it has a projecting flange 216 having a slot 218.

A short knob 219 projects from base 156'. Knob 219 has a threaded bore that receives a screw 220 which has an unthreaded exterior end 222 designed to fit within bracket flange slot 218. The other end of screw 220 has a recessed hexagonal or other shaped bore for reception of a conforming hexagonal key wrench or the like as known in the art. When the screw 220 is extended to have its end 222 in slot 218, base 156 cannot rotate, and shaft 128 is likewise locked against rotation. Base 156' has a pair of grooves 225 for reception of a wrench grip handle as known in the art, so that when screw end 222 is withdrawn from slot 218, the grooves 225 can be gripped to rotate base 156' and shaft 128.

In operation, the sashes 22 and 24 can first be unlocked from each other, such as shown in FIG. 2. In this unlocked mode, sashes 22 and 24 are both free to pivot about hinge assembly 25. Shaft 128 is in the position shown in FIG. 4, with lug 130 and grip 160 pointing downwardly. Sash 22 can be pivoted away from casing 20, and sash 24 pivoted toward casing 20 until the wall 108 of interior sash frame 106 is substantially parallel with surface 68 of outer sash frame 52, such as illustrated for the sash positions of FIG. 4.

With sashes 22 and 24 so aligned, grip 160 is easily rotated by the operator's hand to rotate shaft 128 to move lug 130 to smoothly ride along curved ramp surface 79 of catch flange 78 until lug 130 comes to the position shown in FIGS. 5 and 6. In this position, lug 130 is aligned approximately horizontally and grip 160 points generally horizontally.

With such position, a projection 134 engages a tab 148 (FIG. 7) so that grip 160 cannot be rotated any farther in the counterclockwise (as viewed looking at FIG. 1) direction. As seen in FIG. 6, the lug 130 in this fully rotated position is located in approximately the center of flange 78. With lug 130 engaging catch flange 78, the sashes 22 and 24 are locked together so that as one pivots in either direction, the other pivots in the same direction. Grip 160 can move both sashes together toward the casing 20 until front leg 56 of exterior sash frame 50 is approximately aligned with exterior casing panel 36.

Grip 160 is then easily turned by the hand to rotate lock shaft 128 clockwise (viewed from FIG. 1 perspective). Lug 132 is thereby rotated to ride smoothly on the ramp of catch flange 46 to come to the position shown in FIG. 4. Simultaneously with the said rotation, lug 130 rotates downwardly away from catch flange 78 to point in a vertically downward position. The length of the catch flanges 46 and 78 is such that during such rotation, lug 130 does not disengage from catch flange 78 until lug 132 has contacted flange 46 and begun riding on the curved ramp surface thereof. In this position, upper projection 134 has rotated (counterclockwise as viewed looking at FIG. 7) to engage lower tab 148 to prevent lug 130 from rotating beyond the position of FIG. 4. As was true for the lug 130 and flange 78 positioning of FIG. 6, lug 132 in this fully extended position is approximately centered on flange 46.

With lug 132 pressing against catch flange 46, the gasket 112 is forced against surface 68 of exterior sash 22 to effect a good seal between the area enclosed by pane 172 and interior sash frame 106, and the area outside pane 172 and frame 106.

Moreover, gasket 112, though compressible, is rigid enough to press exterior sash frame 52 and hence exterior sash 22 so that both weatherstrips 60 and 66 are urged into sealing engagement with the interior surface of casing panels 36 and 38, respectively, as shown in FIGS. 2 and 4. This provides a protective seal against temperature, water and debris between exterior sash 22 and exterior casing 28.

With the sashes 22 and 24 mounted in this sealed position, there is no need for concern of the popping loose of a latch holding the sashes 22 and 24 together as encountered in the prior art, since the lug 130 has been disengaged from catch 72.

To pivot the sashes 22 and 24 away from casing 20, grip 160 is easily turned by hand to rotate shaft 128. Lug 132 is thereby rotated free of catch flange 46 to the position of FIGS. 5 and 6. Simultaneously with such rotation, lug 130 rides on the ramp surface 79 of flange 78 to engage the flange 78 as shown in FIGS. 5 and 6. Again the lug 132 does not disengage flange 46 until lug 130 has contacted flange 78. With lug 130 so engaged, grip 160 is grasped and pulled to the interior side 18, to pivot both sashes 22 and 24 to the interior. FIG. 5 shows the sashes 22 and 24 at an early stage of such pivoting.

The aforesaid action of lug 130 engaging and disengaging catch 72 takes place within the confines of the space typically provided in the prior art between the casing 20 and exterior sash 22.

As seen in FIG. 6, the length of catch flange 78 is at least thrice as great as the width of lug 130 from top to bottom. The said width of lug 130 in this definition is the vertical distance from top to bottom which is the same as the width of shaft 128 pictured in FIG. 6. The ratio of flange 78 length to lug 130 width can be greater than five, as shown in FIG. 6. The minimum three to one ratio and the central location of lug 130 on flange 78 gives leeway for sagging of one sash relative to the other while still keeping the two sashes locked together.

The catches 44 and 72, latch shaft 128, handle 154, and brackets 120 and 140 can all be of durable metal, such as of steel or the like.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. An assembly for holding an exterior sash and an interior sash of a window against movement away from a casing located about the exterior and interior sashes, the sashes being movably mounted to the casing so that the sashes can be positioned within the casing and the sashes can both be moved to the interior of the casing to open the window, the casing having an interior side and exterior side, the locking assembly comprising:

(a) means for latching, said latching means having means for locking the exterior sash to the interior sash so that the exterior and interior sash move together;

(b) said latching means having means for locking the interior sash to the casing to hold the interior sash within the casing;

(c) the latching means comprising a member having means for engaging the exterior sash to the interior sash and means for engaging the interior sash to the casing; and (d) means for moving the exterior sash, the said means for moving being mounted between the exterior sash and the interior sash when the interior sash is locked to the casing, and sealing means positioned between the casing and the exterior sash when the interior sash is locked to the casing, wherein when the latching means releases the locking of the exterior sash to the interior sash, the interior sash forces the moving means to move the exterior sash into sealing relationship with the casing.

2. The assembly of claim 1 wherein when the latching means locks the interior sash to the casing, the latching means releases the locking of the interior sash to the exterior sash.

3. The assembly of claim 1 wherein the moving means is a gasket.

4. The assembly of claim 3 wherein the gasket is mounted to the exterior of the interior sash.

5. The assembly of claim 1 wherein the sealing means is weather stripping.

6. The assembly of claim 5 wherein the weather stripping is mounted to the exterior of the exterior sash.

7. The assembly of claim 1 wherein the means for latching comprises a lock shaft associated with the interior sash.

8. The assembly of claim 7 wherein the lock shaft is rotatably mounted to the interior sash.

9. The assembly of claim 8 further comprising a handle mounted on the interior side of the interior sash, means for connecting the handle to the shaft to rotate the shaft by handle movement to lock the exterior sash to the interior sash and lock the interior sash to the casing.

10. The assembly of claim 7 wherein the lock shaft has an interior lug for locking the interior sash to the casing, and a second exterior lug for locking the exterior sash to the interior sash.

11. The assembly of claim 10 wherein the shaft has means limiting rotation of the shaft in the direction towards locking the second lug to the catch of the exterior sash, the catch flange has a length at least three times the distance of the width of the second lug, and wherein the second lug is positioned to be approximately in the center of the catch flange when the second lug is locked to the catch and the shaft is rotated to its limit in the locking direction with the catch.

12. The assembly of claim 10 wherein the means for latching comprises the exterior sash having a catch with a flange for engagement with the second lug to lock the exterior sash to the interior sash.

13. The assembly of claim 12 further comprising the latching means comprising the casing having a second catch for engagement with the interior lug to lock the interior sash to the casing.

14. A locking assembly for holding an exterior sash and an interior sash of a window against movement away from a casing located about the exterior and interior sashes, the sashes being movably mounted to the casing so that the sashes can be positioned within the casing and the sashes can both be pivoted to the interior of the casing to open the window, the casing having an interior side and exterior side, the locking assembly comprising:

(a) means for latching, the said latching means comprising a lock shaft movably mounted to the interior casing, the lock shaft having a first lug for locking the interior sash to the casing, and a second lug for locking the exterior sash to the interior sash;

(b) the lugs being positioned on the shaft so that when the first lug acts to lock the interior sash to the casing, the second lug is disengaged from a locking relationship with the interior sash.

15. The locking assembly of claim 15 wherein the first lug and second lug both project in a radial direction from the lock shaft, and wherein the angle between the lugs radially is approximately ninety degrees.

16. The locking assembly of claim 16 further comprising the interior sash having an exterior side with first means for sealing mounted thereto and the exterior sash has second sealing means mounted thereto, so that when the interior sash is locked to the casing, the interior sash presses the first sealing means against the exterior sash to force the second sealing means on the exterior sash into sealing engagement with the casing.

17. The locking assembly of claim 15 wherein the means for latching further comprises a handle connected to the shaft, the handle being rotatably mounted to the interior sash, and the latching means having means to limit the degree of rotation of the shaft about its axis to approximately ninety degrees.

18. The locking assembly of claim 17 wherein the latching means comprises a first catch associated with the exterior sash, the said catch having a flange with a curved ramp surface for engaging the second lug, and a second catch associated with the casing, the second catch having a curved ramp surface for engagement with the first lug, the length of the first catch being at least three times the width of the second lug, and wherein when the second lug is rotated to its limit towards the locking position it is located approximately in the center of the flange of the first catch.

19. The locking assembly of claim 17 for use with a wrench: wherein the latching means comprises a bracket for mounting a handle base, the bracket having a recess, a handle base, the handle base having slots to receive a wrench, the handle base having a threaded bore, a recessed set screw mounted within the said threaded bore, the set screw having an end which can be moved into the recess of the bracket to prevent rotation of the handle relative to the interior sash, the screw being removable from the said recess so that the wrench can rotate the handle base and the shaft to move the shaft to lock the interior sash to the exterior sash, and to lock the interior sash to the casing.

20. A locking assembly for locking an exterior sash and interior sash of a window against movement away from a casing located about the exterior and interior sashes, the sashes being pivotally mounted to the casing to allow the sashes to both be positioned within the casing and to allow the sashes to be pivoted to the interior of the casing to open the window, the casing having an interior side and an exterior side, the locking assembly comprising:

(a) a means for latching, said means comprising a latch shaft rotatably mounted to the interior sash, the shaft having a first integral lug projecting radially therefrom, and a second exterior integral lug projecting radially therefrom at an angle approximately ninety degrees from the first lug;

(b) the latching means further comprising a first catch associated with the casing, and a second catch associated with the exterior sash;

(c) first means for sealing located on the exterior sash;

(d) second means for sealing located on the exterior of the interior sash;

(e) the first and second catches and the lugs on the shaft having means for being positioned so that when the first lug is moved to engage the first catch, the second lug is moved into a disengaging relationship with the second catch, and so that when the second lug is moved to engage the second catch, the first lug is disengaged from the first catch; and so that when the first lug locks with the first catch, the second sealing means is pressed against the exterior sash to press the first sealing means into sealing engagement with the casing.

21. An assembly for holding an exterior sash and an interior sash of a window against movement away from a casing located about the exterior and interior sashes, the sashes being movably mounted to the casing so that the sashes can be positioned within the casing and the sashes can both be moved to the interior of the casing to open the window, the casing having an interior side and exterior side, the locking assembly comprising:

(a) means for latching comprising a latch member, with said member having integrally connected to it means for locking the exterior sash to the interior sash so that the exterior and interior sash move together;

(b) said latching means further comprising said member having connected integrally to it means for locking the interior sash to the casing to hold the interior sash within the casing; and (c) the part of the latch member between the means for locking the exterior sash to the interior sash and the means for locking the interior sash to the casing being an integral piece.

22. The assembly of claim 21 wherein when the latching means locks the interior sash to the casing, the latching means releases the locking of the interior sash to the exterior sash.

23. The assembly of claim 22 wherein the latching means member comprises a lock shaft, the means for locking the interior sash to the casing comprises the lock shaft having a first lug integrally connected with the shaft, and the means for locking the interior sash to the exterior sash comprises a second lug integrally connected with the shaft, the second lug being exterior to the first lug, the part of the shaft connecting the first lug to the second lug being an integral unitary piece.

24. The assembly of claim 23 wherein when the first lug locks the interior sash to the casing, the second exterior lug unlocks the exterior sash to the interior sash.

25. The assembly of claim 23 wherein the first lug and second lug both project in a radial direction from the lock shaft, and wherein the angle between the lugs radially is approximately 90°.

26. The locking assembly of claim 25 wherein the latching means comprises a first catch connected to the exterior sash, and a second catch connected to the casing.

27. An assembly for holding an exterior sash and an interior sash of a window against movement away from a casing located about the exterior and interior sashes, the sashes being movably mounted to the casing so that the sashes can be positioned within the casing and the sashes can both be moved to the interior of the casing to open the window, the casing having an interior side and an exterior side, the locking assembly comprising:

(a) means for latching, said latching means having means for locking the exterior sash to the interior sash so that the exterior and interior sash move together;

(b) said latching means having means for locking the interior sash to the casing to hold the interior sash within the casing;

(c) the latching means having means for disengaging the interior sash from the exterior sash; and (d) the latching means comprising a shaft having a first lug connected thereto for engaging the exterior sash to the interior sash, and having a second lug connected thereto for engaging the interior sash to the casing, the part of the shaft between the connection with the first lug and the connection with the second lug being integral so that during operation of engaging the interior sash to the exterior sash, and of engaging the interior sash to the casing, and of disconnecting the interior sash from the exterior sash, the part of the shaft between the first lug and the second lug remains connected together.

28. The assembly of claim 27 wherein the first lug and the second lug and the part of the shaft connecting the first lug and the second lug are all integral with one another to constitute a single unitary piece.

29. The locking assembly of claim 28 further comprising:

(a) first means for sealing located on the exterior sash;

(b) second means for sealing located on the exterior of the interior sash;

(c) the first and second catches and the lugs on the first shaft having means for being positioned so that when the first lug is moved to engage the first catch, the second lug is moved into a disengaging relationship with the second catch, and so that when the second lug is moved to engage the second catch, the first lug is disengaged from the first catch; and so that when the first lug locks with the first catch, the second sealing means is pressed against the exterior sash to press the first sealing means into sealing engagement with the casing.

* * * * *